US010367277B2

(12) United States Patent
Lee et al.

(10) Patent No.: US 10,367,277 B2
(45) Date of Patent: Jul. 30, 2019

(54) MULTI-EARTH TERMINAL ASSEMBLY

(71) Applicants: HYUNDAI MOTOR COMPANY, Seoul (KR); KIA MOTORS CORPORATION, Seoul (KR)

(72) Inventors: Cheol Hun Lee, Suwon-si (KR); Soon Chul Kwon, Incheon (KR)

(73) Assignees: HYUNDIA MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/979,695

(22) Filed: May 15, 2018

(65) Prior Publication Data

US 2019/0199016 A1 Jun. 27, 2019

(30) Foreign Application Priority Data

Dec. 22, 2017 (KR) ..... 10-2017-0177642

(51) Int. Cl.
*H01R 11/12* (2006.01)
*H01R 11/09* (2006.01)

(52) U.S. Cl.
CPC ..... *H01R 11/12* (2013.01); *H01R 11/09* (2013.01)

(58) Field of Classification Search
CPC ..... H01R 11/12; H01R 11/09; H01R 11/287; H01R 11/32; H01R 12/57
USPC .... 439/386, 368, 500, 97, 98, 100, 108–110
See application file for complete search history.

(56) References Cited

U.S. PATENT DOCUMENTS 4,357,070 A * 11/1982 Fukushima ..... H01R 13/213 439/287
4,371,230 A * 2/1983 Inoue ..... H01R 11/12 439/849
5,529,509 A * 6/1996 Hayes ..... H01R 11/12 439/288
5,577,927 A * 11/1996 Okada ..... H01R 4/34 439/287
5,586,899 A * 12/1996 Okada ..... H01R 11/12 439/287
7,125,195 B2 10/2006 Hagen
7,125,295 B2 * 10/2006 Zhao ..... H01R 11/12 439/883
7,867,044 B2 * 1/2011 Lee ..... H01R 4/305 439/108

(Continued)

FOREIGN PATENT DOCUMENTS

KR 10-2006-0010282 A 2/2006
KR 10-2010-0115198 A 10/2010

(Continued)

*Primary Examiner* — Harshad C Patel
(74) *Attorney, Agent, or Firm* — Morgan, Lewis & Bockius LLP

(57) ABSTRACT

A multi-earth terminal includes: a body having a hook piece and a hook rib, which are formed on an outer edge of the body; a barrel coupled with a wire; and a connector interconnecting the body with the barrel. Two or more bodies are stacked vertically and coupled to each other. When the two or more bodies are stacked vertically and coupled to each other, each of the two or more bodies includes the hook rib and the hook piece so that the hook rib of a first body that is located at an upper side of the vertically stacked bodies is inserted into and engaged with the hook piece of a second body that is located at a lower side of the vertically stacked bodies.

7 Claims, 5 Drawing Sheets

(56) References Cited

U.S. PATENT DOCUMENTS

| | | | | |
|---|---|---|---|---|
| 8,105,121 | B2 * | 1/2012 | Miyamoto | H01R 4/646<br>439/883 |
| 2004/0040734 | A1 * | 3/2004 | Fujii | H01R 11/12<br>174/84 C |
| 2012/0302089 | A1 * | 11/2012 | Shuey | H01R 11/07<br>439/386 |

FOREIGN PATENT DOCUMENTS

| | | | |
|---|---|---|---|
| KR | 10-1043493 | B1 | 6/2011 |
| KR | 10-1089834 | B1 | 12/2011 |

* cited by examiner

MULTI-EARTH TERMINAL ASSEMBLY

CROSS-REFERENCE TO RELATED APPLICATION

This application claims the benefit of priority to Korean Patent Application No. 10-2017-0177642, filed on Dec. 22, 2017 in the Korean Intellectual Property Office, the disclosure of which is incorporated herein by reference.

TECHNICAL FIELD

The present disclosure relates to a multi-earth terminal, and more particularly, to a multi-earth terminal having a structure in which two or more ground terminals are coupled to each other in a stacked manner and is capable of preventing the two or more ground terminals from being separated from each other when external force acts thereon.

BACKGROUND

In general, an earth terminal used in a vehicle is fastened to a panel in the vehicle so as to connect a circuit of an electronic component and to perform grounding.

The earth terminal has a single earth terminal in which one ground terminal is used individually and a multi-earth terminal in which two or more ground terminals are coupled to each other in a stacked manner.

The multi-earth terminal in which two or more ground terminals are coupled in a stacked manner is advantageous in terms of space utilization compared to a single earth terminal because the multi-earth terminal is able to ground multiple electronic components together.

However, in the multi-earth terminal, there is a high possibility that the ground terminals stacked are separated from each other when external force acts thereon, and when the stacked ground terminals are separated from each other, the ground function may not be performed. In the multi-earth terminal in which two or more ground terminals are coupled in the stacked manner, it may be desirable to ensure that the stacked ground terminals have strong coupling force therebetween.

It should be understood that the foregoing description of the background art is merely for the purpose of promoting the understanding of the background of the present disclosure and should not to be accepted as acknowledging that the background art is known to those skilled in the art.

SUMMARY

An aspect of the present disclosure is to provide a multi-earth terminal structure, in which two or more ground terminals are coupled to each other in a stacked manner, the stacked ground terminals can be more firmly coupled to each other, which prevents the ground terminals from being separated from each other when external force acts thereon, so that the ground function can be performed more stably.

In order to achieve the aspects described above, a multi-earth terminal of the present disclosure includes: a body having a hook piece and a hook rib on an outer edge of the body; a barrel coupled with a wire thereto; and a connector interconnecting the body and the barrel. Two or more bodies may be stacked vertically and coupled to each other, and when the two or more bodies are stacked vertically and coupled to each other, the hook rib of a first body located at an upper side of the vertically stacked bodies is inserted into and engaged with the hook piece of a second body located at a lower side of the vertically stacked bodies.

The hook rib has an inclined surface formed on an upper surface of an end portion thereof so as to guide smooth insertion of the hook rib when the hook rib of the first body is inserted into the hook piece of the second body.

The multi-earth terminal further includes a hook projection formed to protrude from a surface of the hook rib, and the hook projection comes into close contact with an inner surface of the hook piece when the hook rib of the first body is inserted into the hook piece of the second body.

A plurality of hook pieces is formed on the outer edge of the body by being spaced apart from each other at a predetermined interval, and the hook rib is formed to extend in one direction along the outer edge of the body while being connected to each of the hook pieces.

The multi-earth terminal further includes an engagement hole formed to open toward an outer edge of the connector at one side of the connector, and a hook boss formed to protrude from a surface of the connector. When the vertically stacked bodies are rotated relative to each other, the hook boss of the second body is inserted into and engaged with the engagement hole of the first body.

The engagement hole has an engagement step formed along an edge thereof and having a thickness which is relatively smaller than the connector, and the hook boss has an engagement jaw formed at an end of the hook boss and having a diameter larger than a diameter of the hook boss. When the hook boss is inserted into the engagement hole, the engagement jaw on the hook boss located at the lower side is seated on and engaged with the engagement step in the engagement hole.

The multi-earth terminal further includes an elastic channel formed at a side of the engagement hole to open in a same direction as the engagement hole, and an elastic arm formed between the elastic channel and the engagement hole. When the hook boss is inserted into the engagement hole, the elastic arm accumulates elastic force while being elastically deformed, and after the hook boss is inserted into the engagement hole, the elastic arm presses and supports the hook boss with the accumulated elastic force.

The elastic arm has one side surface in one end thereof, which is connected to the engagement hole and is formed as an inclined surface so as to guide smooth insertion of the hook boss when the hook boss is inserted into the engagement hole.

Among the two or more vertically stacked bodies, a third body, which is located at a lowermost position, has a fixing hook protruding downward The embodiment disclosed herein is a multi-earth terminal structure in which the bodies of two or more ground terminals are coupled to each other in a stacked manner such that, when upper and lower ground terminals are rotated relative to each other, hook ribs on the upper ground terminal are engaged with hook pieces, so that the upper and lower ground terminals are coupled to each other. As a result, the upper and lower ground terminals can maintain stronger coupling force, and as a result, the upper and lower ground terminals can be prevented from being separated from each other even when external force acts thereon.

In addition, when the hook ribs on the upper ground terminal are respectively inserted into the hook pieces of the lower ground terminal, the hook projections formed on the hook ribs on the upper ground terminal come into close contact with the inner surfaces of the hook pieces. As the hook projections are engaged in this way, the engagement between the hook pieces and the hook ribs is further strengthened.

In addition, when the upper ground terminal and the lower ground terminal are rotated relative to each other in the state of being overlapped each other, the hook boss on the lower ground terminal is inserted into and engaged with the engagement hole in the upper ground terminal. At this time, the elastic arm elastically presses and supports the hook boss inserted into the engagement hole. Thus, the hook boss inserted into the engagement hole is engaged more firmly by the elastic arm, so that the upper and lower ground terminals can be prevented from being separated from each other.

In addition, the hook boss on the lower ground terminal is inserted into the engagement hole in the upper ground terminal. At this time, the engagement jaw on the hook boss on the upper ground terminal is seated on the engagement step in the engagement hole in the lower ground terminal. By the engagement between the engagement step and the engagement jaw, the upper ground terminal is prevented from being lifted upward, so that the upper and lower ground terminals can be prevented from being separated from each other.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION OF THE EXEMPLARY EMBODIMENTS

Figure 1:
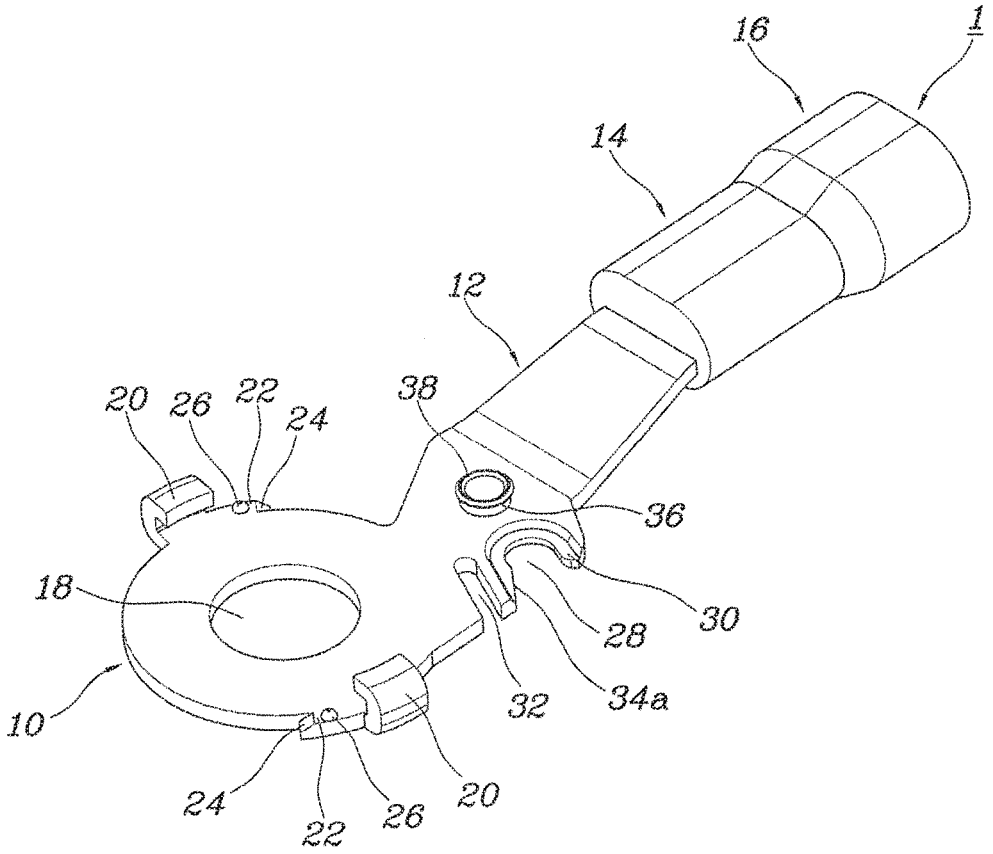
FIG. 1 is a view for explaining a multi-earth terminal according to the present disclosure, in which a perspective view of one ground terminal is illustrated.
Figure 2:
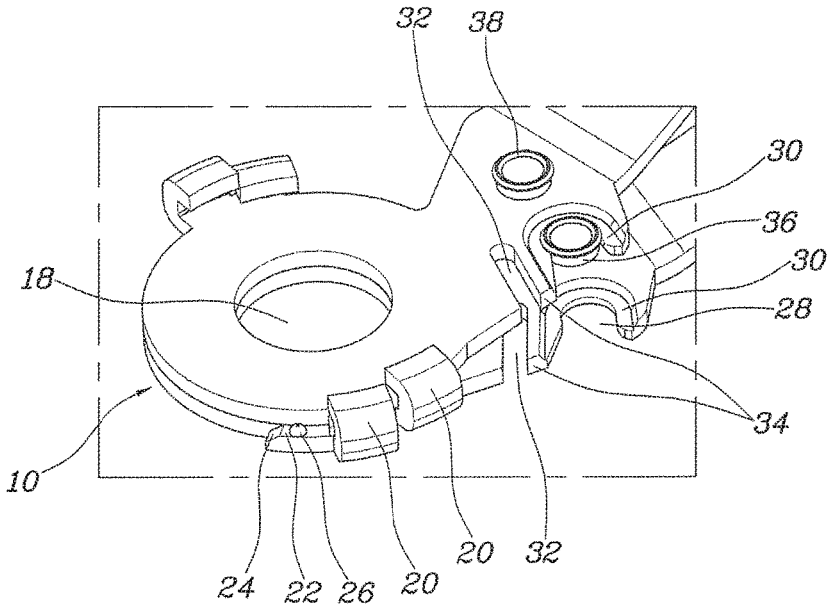
FIG. 2 is a view illustrating a state in which the body portions of two ground terminals are stacked vertically.

Hereinafter, a multi-earth terminal according to various embodiments of the present disclosure will be described with reference to the accompanying drawings.

As illustrated in FIGS. 1 to 5, in a multi-earth terminal according to the present disclosure, at least two ground terminals 1 are coupled in a stacked manner. Each of the at least two ground terminals 1 includes: a ring-shaped body portion 10; a connecting portion 12 connected to the body portion 10; and a barrel portion 14 located away from the body portion 10 with respect to the connecting portion 12 and coupled to a wire 16.

The body portion 10 of one ground terminal 1 may be in electrical contact with the body portion 10 of another ground terminal 1, and has a fastening through hole 18 formed at the center thereof. A coupling member such as a bolt passes through the fastening through hole 18 so as to be coupled to a vehicle body panel.

U-shaped hook pieces 20 are formed on the outer edge of the body portion 10 so that the hook pieces 20 are spaced apart from each other at intervals of 120 degrees along the outer edge of the body portion 10.

Each of the hook pieces 20 extends outward from the outer edge of the body portion 10, and is then bent upward and then inward, thereby forming a U shape. The edge of the body portion 10 of another ground terminal 1 is fixedly hooked to the hook pieces 20.

Hook ribs 22, which are respectively connected to the hook pieces 20, are formed on the body portion 10 along the outer edge of the body portion 10. Each of the hook ribs 22 protrudes from the outer edge of the body portion 10 in a circular arc shape over a predetermined length. When two or more ground terminals 1 are stacked vertically and coupled to each other, the hook pieces 20 on the ground terminal 1, which is located at the upper side, (hereinafter, referred to as the "upper ground terminal 1") are respectively hooked and engaged with the hook ribs 22 on the ground terminal 1, which is located at the lower side (hereinafter, referred to as the "lower ground terminal 1").

The hook ribs 22 are formed adjacent to the hook pieces 20, respectively. That is, the hook pieces 22 are respectively connected to the hook pieces 20 illustrated in FIG. 1 along the clockwise direction.

The upper surface of the end of each hook rib 22 is formed as an inclined surface 24. The hook ribs 22 on the upper ground terminal 1 are respectively inserted into the hook pieces 20 on the lower ground terminal 1. At this time, the inclined surfaces 24 guide the hook ribs 22 on the upper ground terminal 1 to be inserted more smoothly into the hook pieces 20 on the lower ground terminal 1.

In addition, a hook projection 26 protruding in a hemispherical shape is formed on the surface of each hook rib 22, so that when the hook ribs 22 on the upper ground terminal 1 are inserted into the lower hook pieces 20 of the ground terminal, the hook projections 26 on the upper ground terminal 1 are inserted into the lower hook pieces so as to come in close contact with the inner surfaces of the hook pieces 20. As a result, the engagement between the hook pieces 20 and the hook ribs 22 is maintained more firmly.

Between the body portion 10 and the connecting portion 12, an engagement hole 28 is formed to be open toward the outer edge. In the state in which the upper ground terminal 1 and the lower ground terminal 1 overlap each other, when the ground terminals 1 are rotated relative to each other, a hook boss 36 on the lower ground terminal 1 is inserted into and engaged in the engagement hole 28 in the upper ground terminal 1.

An engagement step 30 is formed along the edge of a groove forming the engagement hole 28. The engagement step is formed to be slightly lower than the surface of the connecting portion 12 so that the engagement step 30 has a thickness which is relatively smaller than that of the connecting portion 12. An engagement jaw 38 of the hook boss 36, which will be described later, is seated on the engagement step 30.

An elastic channel 32 is formed at a side of the engagement hole 28, which is open in the same direction as the engagement hole 28, and an elastic arm 34 is formed between the engagement hole 28 and the elastic channel 32.

The elastic arm 34 is elastically deformed in the direction of narrowing the elastic channel 32 in the process of inserting the hook boss 36 into the engagement hole 28 so that the elastic arm 34 accumulates elastic force. After the hook boss 36 is inserted into the engagement hole 28, the hook boss 36 is pressed and supported by the accumulated elastic force, so that the hook boss 36 inserted into the engagement hole 28 can be engaged more firmly.

The elastic arm 34 is formed integrally with the connecting portion 12 and is made to be elastically deformable due to the elastic channel 32. As the elastic channel 32 is formed in the connecting portion 14, the elastic arm 34 is formed, and the elastic arm 34 is elastically deformed when the hook boss 36 is inserted into the engagement hole 28.

The elastic arm 34 has a predetermined inclination with respect to the longitudinal direction of the connecting portion 12, and one side surface connected to the engagement hole 28 at the end of the elastic arm 34 is formed as an inclined surface 34*a*. The inclined surface 34*a* serves to guide the hook boss 36 to be more smoothly inserted when the hook boss 36 is inserted into the engagement hole 28.

The hook boss 36, which protrudes upward from the upper surface of the connecting portion 12, is formed at a side of the engagement hole 28, and the engagement jaw 38 is formed on the end of the hook boss 36. The hook boss 36 has a cylindrical shape, the engagement jaw 38 is a portion radially enlarged from the end of the hook boss 36, so that the hook boss 36 is a portion having the largest diameter in the engagement jaw 38.

Accordingly, when the ground terminals 1 rotate relative to each other in the state where the upper ground terminal 1 and the lower ground terminal 1 overlap each other, the hook boss 36 of the lower ground terminal 1 is inserted into the engagement hole 28 in the upper ground terminal 1. At this time, the engagement jaw 38 in the hook boss 36 of the lower ground terminal 1 is seated on the engagement step 30 in the engagement hole 28 of the upper ground terminal 1.

Since the upper ground terminal 1 is prevented from being lifted up by the engagement between the engagement step 30 and the engagement jaw 38 in the state in which the upper ground terminal 1 and the lower ground terminal 1 are coupled to overlap each other, it is possible to prevent the upper ground terminal 1 from being separated from the lower ground terminal 1.

Hereinafter, descriptions will be made of a case in which a plurality of ground terminals 1 according to the present disclosure, each having the above-described configuration, is used in the state of being coupled to each other.

Figure 4:
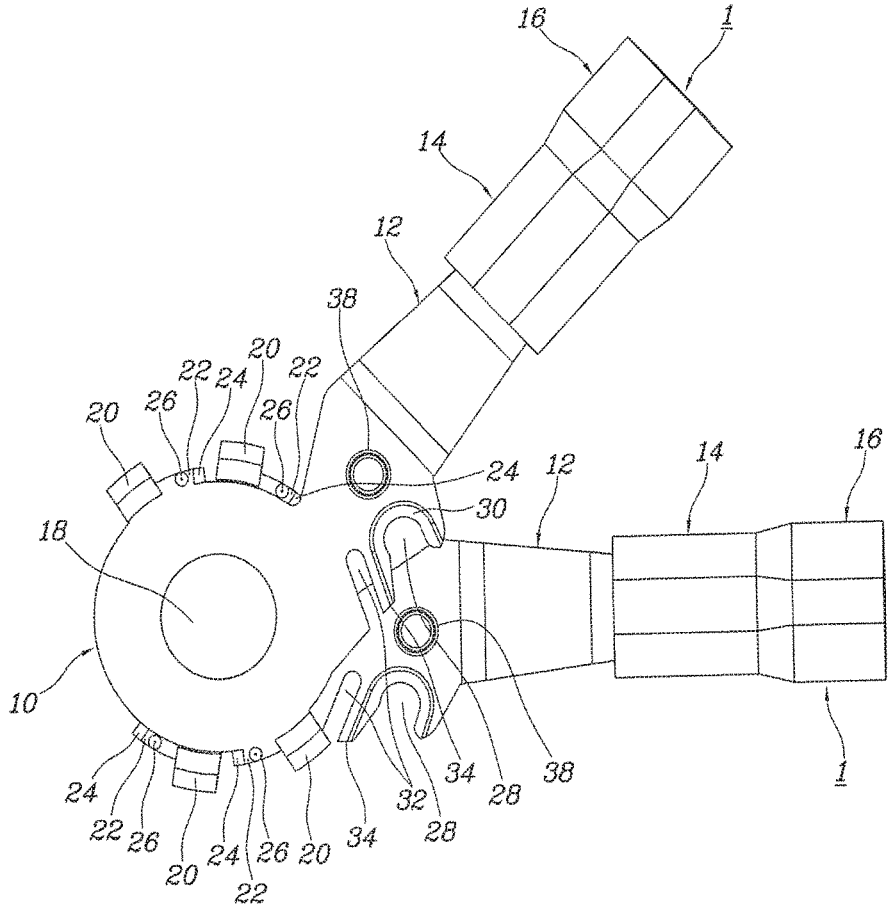
FIG. 4 is a view illustrating a state in which two ground terminals are stacked but are not yet coupled to each other.

FIG. 4 illustrates a state in which the body portions of two ground terminals 1 are in close contact with each other.

The inclined surface 24 of each of the hook ribs 22 of the body portion 10 in the upper ground terminal 1 is located at one side of one of the hook pieces 20 of the body portion 10 in the lower ground terminal 1, and the hook boss 36 in the lower ground terminal 1 is located near the entrance of the engagement hole 28 in the upper ground terminal 1.

In the state of FIG. 4, when the upper and lower ground terminals 1 are rotated relative to each other so that the hook ribs 22 of the hook pieces 20 in the upper ground terminal are inserted into the hook pieces 20 in the lower ground terminal, the hook ribs 22 in the upper ground terminal are introduced into and engaged in the hook pieces in the lower ground terminal. At this time, the hook projections 26 formed on the hook ribs 22 in the upper ground terminal are brought into close contact with the inner surfaces of the hook pieces 20 in the lower ground terminal so that the hook pieces 20 and the hook ribs 22 are firmly engaged with each other.

Simultaneously, with the above-mentioned operation, the hook boss 36 in the lower ground terminal is pressed into the engagement hole 28 in the upper ground terminal.

When the upper and lower ground terminals are relatively rotated, the hook boss 36 in the lower ground terminal, which has been located near the entrance of the engagement hole 28 in the upper ground terminal, is inserted into the engagement hole 28 while being guided along one side edge of the elastic arm 34. At this time, in the process in which the hook boss 36 is inserted into the engagement hole 28, the elastic arm 34 is pushed toward the elastic channel 32 to be elastically deformed, and when the hook boss 36 is completely inserted into the engagement hole 28, the elastic arm 34 is restored from the elastically deformed state. In this process, since the elastic arm 34 elastically presses and supports the hook boss 36, the hook boss 36 inserted into the engagement hole 28 can be firmly held by the elastic arm 34.

Even in the state in which the hook boss 36 is inserted into the engagement hole 28 and then the elastic arm 34 is partially restored from elastic deformation, the hook boss 36 inserted into the engagement hole 28 always can be maintained in the firm engagement state by the elastic support force of the elastic arm 34. This makes it difficult for the hook boss 36 to be disengaged from the engagement hole 28.

Figure 5:
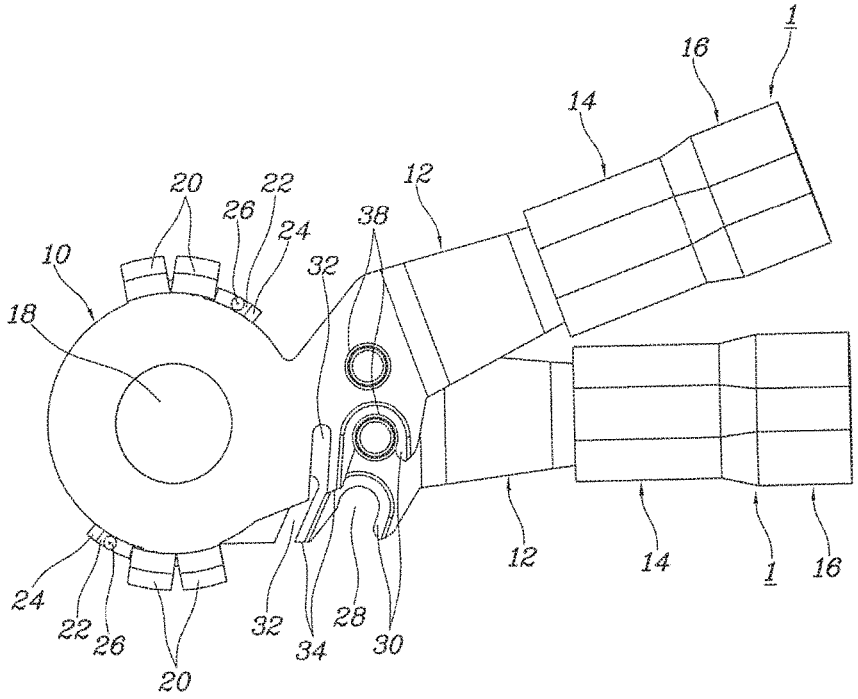
FIG. 5 is a view illustrating two ground terminals are stacked and coupled to each other.

FIG. 5 illustrates a state in which two ground terminals are fully coupled to each other.

When the hook boss 36 is inserted into the engagement hole 28, the engagement jaw 38 formed around the upper edge of the hook boss 36 is seated on the engagement step 30.

The upper ground terminal and the lower ground terminal are restrained from moving in the direction in which the upper and lower ground terminals are separated from each other by the engagement jaw 38 being seated in the engagement end 30. Due to this, even if the barrel portion 14 of the upper ground terminal is lifted due to external force applied to the wire 16, the stacked upper and lower ground terminals are prevented from being separated up and down from each other, so that the coupling state can be maintained more firmly.

In addition, in the state in which the hook boss 36 is inserted into the engagement hole 28, the upper and lower ground terminals 1 are not rotated relative to each other. That is, since the relative rotation in the direction in which the hook boss 36 escapes from the engagement hole 28 is prevented, the upper and lower ground terminals 1 do not rotate relative to each other.

In addition, by the engagement between the hook pieces and the hook ribs 22, the coupled state between the body portions 10 of the upper and lower ground terminals 1 is maintained more firmly, so that the upper and lower ground terminals are not separated from each other. Particularly, as the hook projections 26 on the hook ribs 22 are brought into close contact with the inner surfaces of the hook pieces 20, the upper and lower ground terminals 1 hardly rotate relative to each other.

Figure 3:
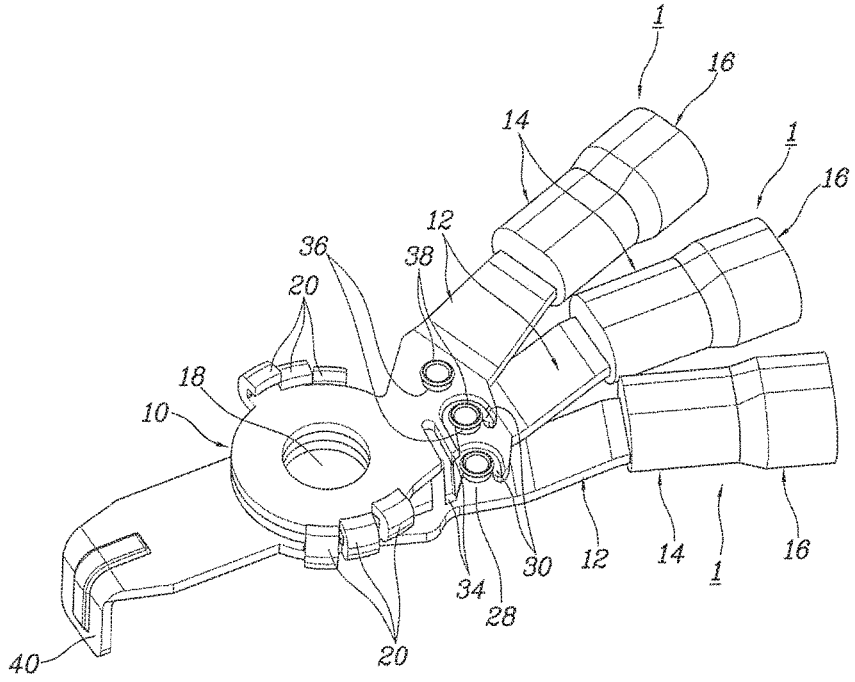
FIG. 3 is a view illustrating a stacked state of three ground terminals.

Meanwhile, as illustrated in FIG. 3, among two or more overlapping ground terminals, the lowermost ground terminal 1 has a fixing hook 40 formed to protrude from the body portion 10, and the fixing hook 40 is fitted to and engaged with a slot formed in a vehicle body panel. As a result, the lowermost ground terminal 1 is prevented from being rotated at the time when fastening the lowermost ground terminal 1 to the vehicle body panel using a bolt.

The body portions 10 of the plurality of ground terminals 10 is sequentially stacked on the body portion 10 of the lowermost ground terminal so as to be coupled to each other. FIG. 3 illustrates a state in which three ground terminals are coupled to each other in a stacked manner.

In addition, in order to separate the coupling between the ground terminals 1, for example, the upper ground terminal may be rotated around the coupling hole 18 of the main body 10 in the direction opposite to the direction indicated by an arrow in FIG. 4.

By this rotation, the hook pieces 20 are disengaged from the hook ribs 22, and the hook boss 36 escapes from the engagement hole 28, so that the ground terminals are separated from each other.

As described above, according to the embodiment of the present disclosure, in the structure of the multi-earth terminal in which the body portions 10 of the two or more ground terminals 1 are coupled to each other in a stacked manner, the hook ribs 22 of the upper ground terminal 1 are configured to be hooked and engaged with the hook pieces 20 of the lower ground terminal 1 when the upper and lower ground terminals are rotated relative to each other, through which the upper and lower ground terminals can be maintained with stronger coupling force.

In addition, when the hook ribs 22 of the upper ground terminal 1 are respectively inserted into the hook pieces of the lower ground terminal 1, the hook projections 26 formed on the hook ribs 22 in the upper ground terminal 1 are inserted into the hook pieces 20 in the lower ground terminal 1 and are brought into close contact with the inner surfaces of the hook pieces 20. The engagement between the hook pieces 20 and the hook ribs 22 can be maintained more firmly by the engagement of the hook projections 26.

In the state in which the upper ground terminal 1 and the lower ground terminal 1 overlap each other, when the ground terminals 1 are rotated relative to each other, the hook boss 36 on the lower ground terminal 1 is inserted into and engaged with the engagement hole 28 in the upper ground terminal 1. At this time, the elastic arm 34 is configured to elastically press and support the hook boss 36 inserted into the engagement hole 28. Thus, the hook boss 36 inserted into the engagement hole 28 can be more firmly engaged with the engagement hole 28 by the elastic arm 34 and the upper and lower ground terminals 1 can be prevented from being separated from each other.

In addition, the hook boss 36 in the lower ground terminal 1 is inserted into the engagement hole 28 in the upper ground terminal 1 and at this time, the engagement jaw 38 of the hook boss 36 in the lower ground terminal 1 is configured to be seated on the engagement step 30 of the engagement hole 28. Since the upper end of the upper ground terminal 1 is prevented from being lifted up by the engagement between the engagement step 30 and the engagement jaw 38, it is possible to prevent the upper and lower ground terminals 1 from being separated from each other.

While the present disclosure has been illustrated and explained with respect to specific embodiments thereof, it will be obvious to a person ordinarily skilled in the art that the present disclosure can be variously modified and changed without departing from the scope of the technical idea of the present disclosure, which is defined by the accompanying claims.

What is claimed is:

1. A multi-earth terminal assembly comprising:

two or more multi-earth terminals, wherein each of the two or more multi-earth terminals comprising:

a body having a hook piece and a hook rib on an outer edge of the body;

a barrel coupled with a wire;

a connector interconnecting the body with the barrel;

an engagement hole open toward an outer edge of the connector at one side of the connector; and a hook boss protruding from a surface of the connector, wherein two or more bodies are stacked vertically and coupled to each other, and wherein when the two or more bodies are stacked vertically and coupled to each other, each of the two or more bodies includes the hook rib and the hook piece so that the hook rib of a first body that is located at an upper side of the vertically stacked bodies is inserted into and engaged with the hook piece of a second body that is located at a lower side of the vertically stacked bodies, wherein, when the vertically stacked bodies rotate relative to each other, the hook boss of the second body is inserted into and engaged with the engagement hole of the first body, wherein the engagement hole has an engagement step along an edge of the engagement hole and having a thickness which is relatively smaller than the connector, wherein the hook boss has an engagement jaw at an upper end of the hook boss, the engagement jaw having a diameter larger than a diameter of the hook boss, and wherein, when the hook boss is inserted into the engagement hole, the engagement jaw on the hook boss located at the lower side is seated on and engaged with the engagement step in the engagement hole.

2. The multi-earth terminal assembly of claim 1, wherein the hook rib has an inclined surface on an upper surface of an end portion of the hook rib so that the inclined surface of the hook rib first enters the hook piece when the hook rib of the first body is inserted into the hook piece of the second body.

3. The multi-earth terminal assembly of claim 1, further comprising:

a hook projection protruding from a surface of the hook rib, wherein the hook projection comes into close contact with an inner surface of the hook piece when the hook rib of the first body is inserted into the hook piece of the second body.

4. The multi-earth terminal assembly of claim 1, wherein the outer edge of the body has a plurality of hook pieces spaced from each other at a predetermined interval on the outer edge of the body, and the hook rib extends in one direction along the outer edge of the body while being in connect with each of the plurality of hook pieces.

5. The multi-earth terminal assembly of claim 1, further comprising:

an elastic channel spaced apart from the engagement hole to open in a same direction as the engagement hole; and an elastic arm between the elastic channel and the engagement hole, wherein, when the hook boss is inserted into the engagement hole, the elastic arm accumulates elastic force while being elastically deformed so that the elastic arm presses and supports the hook boss with the accumulated elastic force.

6. The multi-earth terminal assembly of claim 5, wherein the elastic arm has one side surface at one end of the elastic arm as an inclined surface, which is connected to the engagement hole to guide smooth insertion of the hook boss when the hook boss is inserted into the engagement hole.

7. The multi-earth terminal assembly of claim 1, wherein among the two or more vertically stacked bodies, a third body, which is located at a lowermost position of the vertically stacked bodies, has a fixing hook disposed away from the barrel and protruding downward.

* * * * *